US009390589B2

(12) United States Patent
Gupta

(10) Patent No.: US 9,390,589 B2
(45) Date of Patent: Jul. 12, 2016

(54) METHOD OF GAMING, A GAME CONTROLLER AND A GAMING SYSTEM

(75) Inventor: Lipi Gupta, Rosebery (AU)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 545 days.

(21) Appl. No.: 13/544,697

(22) Filed: Jul. 9, 2012

(65) Prior Publication Data

US 2013/0337882 A1 Dec. 19, 2013

(30) Foreign Application Priority Data

Jun. 18, 2012 (AU) ..... 2012203544

(51) Int. Cl.
*G07F 17/32* (2006.01)

(52) U.S. Cl.
CPC ..... *G07F 17/3267* (2013.01)

(58) Field of Classification Search
CPC ... G07F 17/32; G07F 17/326; G07F 17/3262; G07F 17/3265; G07F 17/3267
USPC ..... 463/16–20, 25, 30
See application file for complete search history.

(56) References Cited

U.S. PATENT DOCUMENTS

| | | | | |
|---|---|---|---|---|
| 6,328,649 | B1 * | 12/2001 | Randall et al. | 463/20 |
| 6,582,303 | B1 * | 6/2003 | Weiss | 463/16 |
| 6,669,559 | B1 * | 12/2003 | Baerlocher et al. | 463/16 |
| 6,676,512 | B2 | 1/2004 | Fong et al. | |
| 7,666,083 | B2 | 2/2010 | Baerlocher et al. | |
| 2002/0119814 | A1 | 8/2002 | Fong et al. | |
| 2003/0045350 | A1 * | 3/2003 | Baerlocher et al. | 463/25 |
| 2003/0199295 | A1 * | 10/2003 | Vancura | 463/16 |
| 2005/0054435 | A1 * | 3/2005 | Rodgers et al. | 463/25 |
| 2006/0068884 | A1 | 3/2006 | Baerlocher et al. | |
| 2007/0243923 | A1 * | 10/2007 | Seelig et al. | 463/16 |
| 2009/0124371 | A1 | 5/2009 | Gilmore et al. | |
| 2011/0034241 | A1 | 2/2011 | Englman et al. | |

FOREIGN PATENT DOCUMENTS

| | | | |
|---|---|---|---|
| EP | 0375190 | | 6/1990 |
| EP | 1378875 | A1 | 1/2004 |
| GB | 2067807 | A | 7/1981 |
| GB | 2097570 | A | 11/1982 |
| GB | 2135490 | | 8/1984 |
| GB | 2180087 | | 3/1987 |
| GB | 2222712 | | 3/1990 |
| GB | 2296360 | | 6/1996 |
| GB | 2335066 | | 9/1999 |
| GB | 2405981 | A | 3/2005 |
| JP | 2001009084 | A | 1/2001 |
| JP | 4127929 | B2 | 7/2008 |
| WO | 2005026886 | | 3/2005 |
| WO | 2008133850 | | 11/2008 |

* cited by examiner

*Primary Examiner* — Jasson Yoo
(74) *Attorney, Agent, or Firm* — McAndrews, Held & Malloy, Ltd.

(57) ABSTRACT

An electronic method of gaming comprising: displaying a sequence of first awards including a current first award; receiving one or more selections with respect to a plurality of second awards until an award condition is met; modifying the display of the sequence of first awards to sequentially advance the display of the sequence of first awards to thereby change the current first award whenever the one or more selections are received; and making the current first award when the award condition is met.

21 Claims, 7 Drawing Sheets

METHOD OF GAMING, A GAME CONTROLLER AND A GAMING SYSTEM

RELATED APPLICATIONS

This application claims priority to Australian Provisional Patent Application No. 2012203544, having a filing date of Jun. 18, 2012, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a method of gaming, a game controller and a gaming system.

Some gaming machines have more than one display. Typically, each one of the displays of such machines is used to display a different game. With one such machine, one of the displays is used to display a base game and the other one of the displays is used to display a bonus game. The bonus game is activated when a particular gaming outcome occurs during the base game. While the player is playing the bonus game, the base game is suspended. The base game resumes after the player finishes playing the bonus game.

While existing machines provide players with enjoyment, a need exists for alternative or improved machines to maintain or increase player enjoyment.

BRIEF SUMMARY OF THE INVENTION

In a first aspect, the invention provides an electronic method of gaming comprising:

displaying a sequence of first awards including a current first award;

receiving one or more selections with respect to a plurality of second awards until an award condition is met;

modifying the display of the sequence of first awards to sequentially advance the display of the sequence of first awards to thereby change the current first award whenever the one or more selections are received; and making the current first award when the award condition is met.

In an embodiment, the second awards correspond to respective objects displayed on a display.

In an embodiment, the one or more selections are made by a user selecting one or more of the objects displayed on the display.

In an embodiment, the award condition is that one of the objects selected by the user matches a designated object displayed on the display.

In an embodiment, the award condition is that one of the objects selected by the user matches another one of the objects selected by the user.

In an embodiment, the award condition is that one of the objects selected by the user matches one of the objects previously selected by the user.

In an embodiment, the second awards are not revealed on the display to the user prior to the user selecting the objects.

In an embodiment, the electronic method further comprises revealing the second awards corresponding to the objects selected by the user on the display upon the user selecting the objects.

In an embodiment, the electronic method further comprises concealing the second awards corresponding to the objects selected by the user on the display when the award condition is not met.

In an embodiment, the second awards corresponding to the objects selected by the user are concealed prior to the user selecting another one or more of the objects on the display.

In an embodiment, the first awards correspond to respective balls in a spinning wheel type enclosure.

In an embodiment, the first awards are modified by rotating the spinning wheel type enclosure.

In an embodiment, the spinning wheel type enclosure is spun prior to receiving any selections.

In an embodiment, the spinning wheel type enclosure is re-spun whenever the current first award is made.

In an embodiment, each one of the first awards is a multiplier.

In an embodiment, the current first award is made by applying the multiplier corresponding to the current first award to the second award corresponding to the object matching the designated object.

In an embodiment, the current first award is made by applying the multiplier corresponding to the current first award to the second award corresponding to any one of the matching objects selected by the user.

In an embodiment, the designated object is displayed together with the respective objects on the display in the form of an array.

In a second aspect, the invention provides a game controller for a gaming system, the game controller arranged to:

display a sequence of first awards including a current first award;

receive one or more selections with respect to a plurality of second awards until an award condition is met;

modify the display of the sequence of first awards to sequentially advance the display of the sequence of first awards to thereby change the current first award whenever the one or more selections are received; and make the current first award when the award condition is met.

In an embodiment, the game controller is further arranged to determine whether or not an award condition is met.

In a third aspect, the invention provides a gaming system comprising:

a display; and a game controller arranged to:

display on the display a sequence of first awards including a current first award;

receive one or more selections with respect to a plurality of second awards until an award condition is met;

modify the display of the sequence of first awards to sequentially advance the display of the sequence of first awards to thereby change the current first award whenever the one or more selections are received; and make the current first award when the award condition is met.

In an embodiment, the display is a spinning wheel type enclosure, and the first awards correspond to respective balls in the spinning wheel type enclosure.

In an embodiment, the game controller is further arranged to determine whether or not an award condition is met.

In a fourth aspect, the invention provides a gaming machine comprising:

a first award controller arranged to display on a display a sequence of first awards including a current first award;

a selection receiver arranged to receive one or more selections with respect to a plurality of second awards until an award condition determiner determines that an award condition is met;

a first award modifier arranged to modify the display of the sequence of first awards to sequentially advance the display of the sequence of first awards to thereby change the current first award whenever the selection receiver receives the one or more selections; and a prize awarder arranged to make the current first award when the award condition determiner determines that the award condition is met.

In an embodiment, the gaming machine further comprises the display.

In an embodiment, the gaming machine further comprises the award condition determiner.

In a fifth aspect, the invention provides computer program code which when executed implements the above method.

In a sixth aspect, the invention provides a tangible computer readable medium comprising the above program code.

In a seventh aspect, the invention provides a data signal comprising the above program code.

In an eighth aspect, the invention extends to transmitting the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
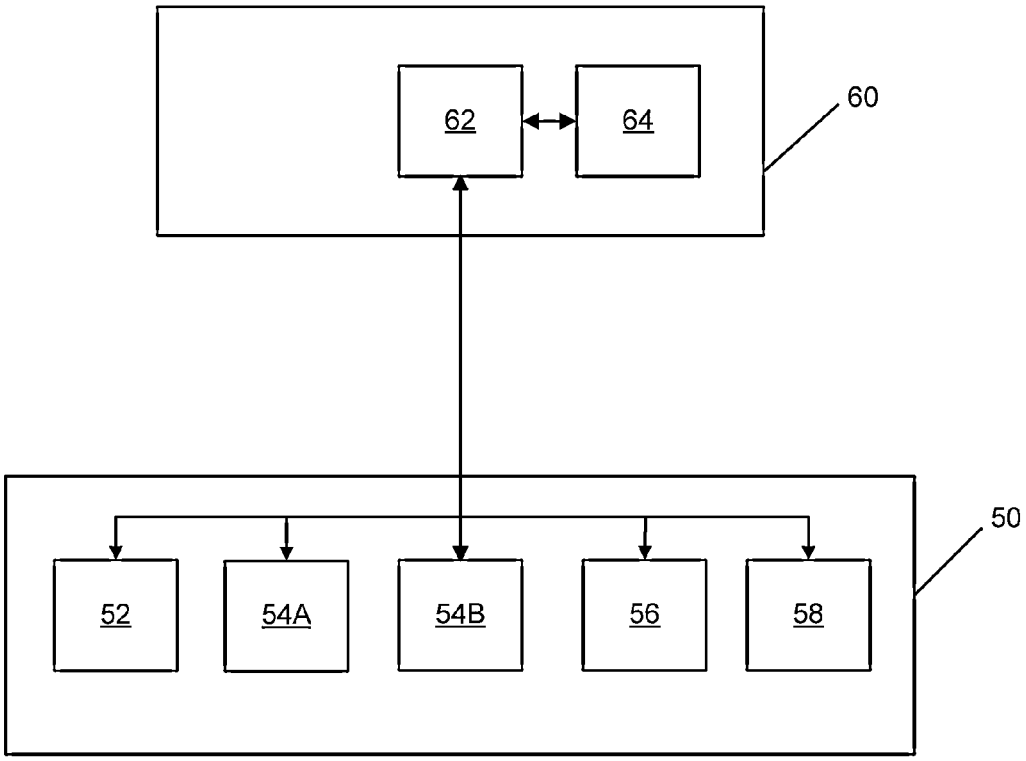
FIG. 1 is a block diagram of the core components of a gaming system.

Referring to the drawings, there is shown a gaming system arranged to implement a game where a sequence of first awards including a current first award are displayed and one or more selections with respect to a plurality of second awards are received until an award condition is met. Whenever the one or more selections are received, the display of the sequence of first awards is modified to sequentially advance the display of the sequence of first awards to thereby change the current first award. The current first award is made when the award condition is met.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54A, 54B, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
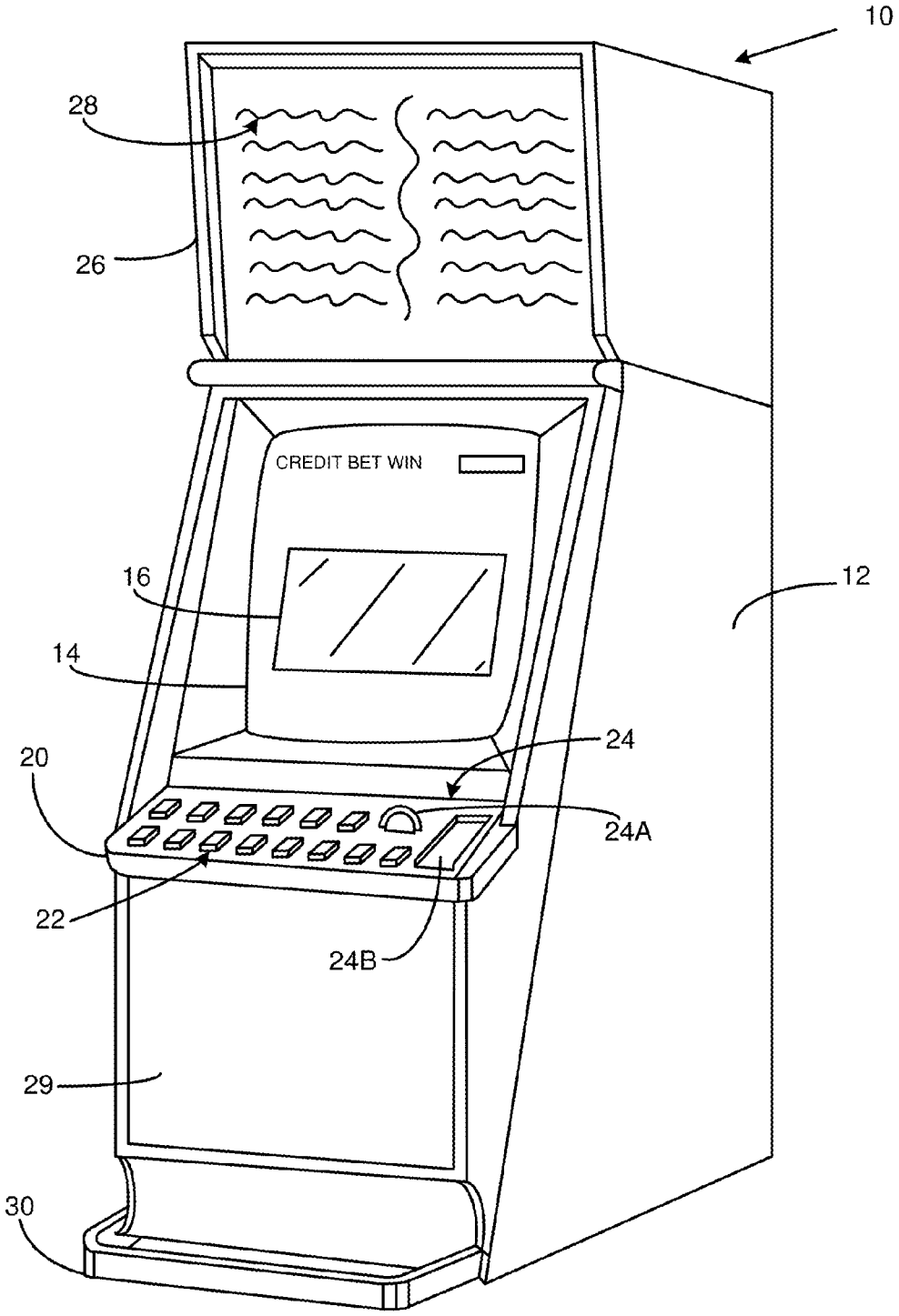
FIG. 2 is a perspective view of a standalone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. Also, the gaming machine includes another display (not shown) in the form of a spinning wheel type enclosure containing a series of balls displaying respective awards. Persons skilled in the art will appreciate that the spinning wheel type enclosure may be provided on the gaming machine in different ways. For example, the spinning wheel type enclosure may be mounted on the top box 26 as a separate physical component of the gaming machine or provided by a video display of the top box 26.

Figure 3:
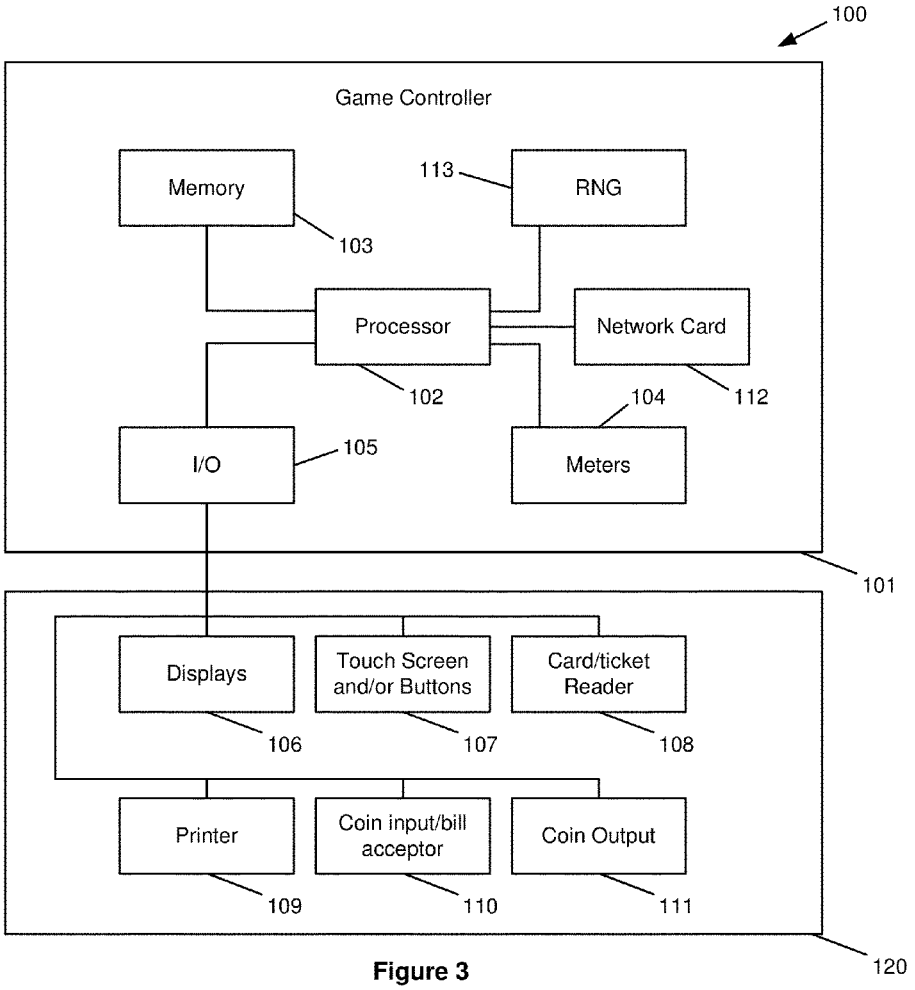
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
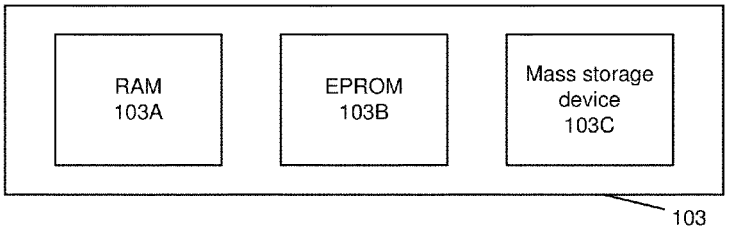
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
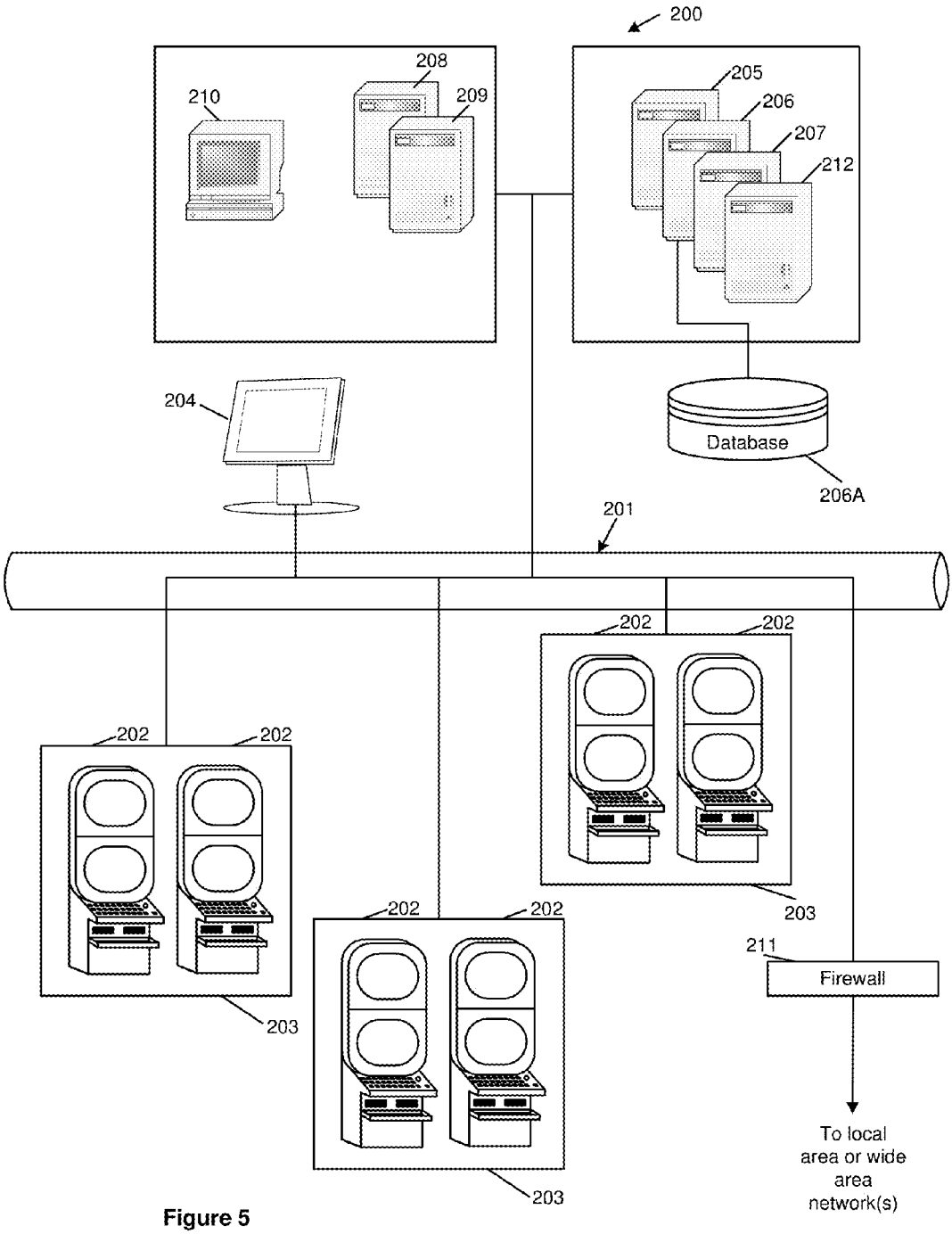
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 6:
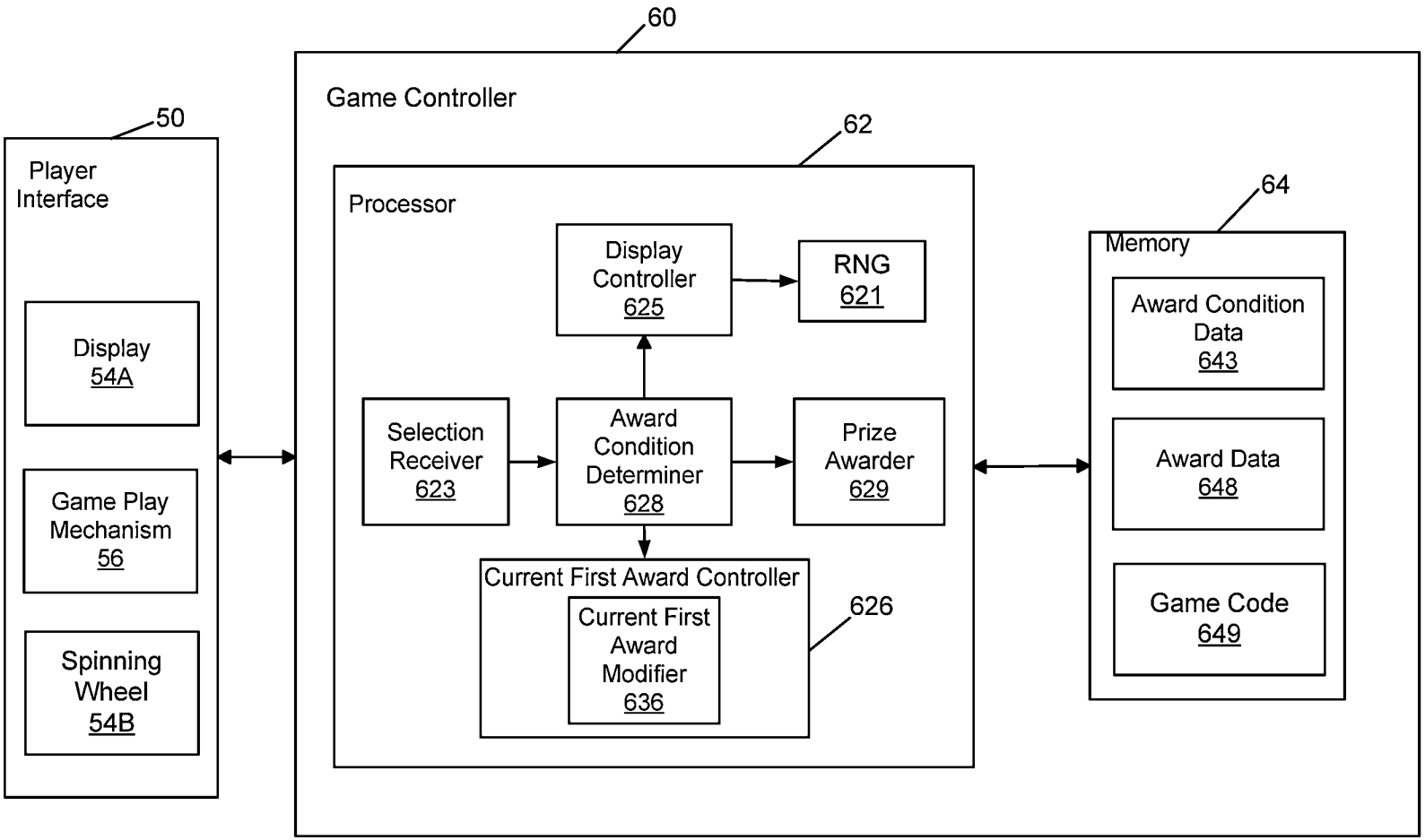
FIG. 6 is a further block diagram of a gaming system.

FIG. 6 shows the functional components of an embodiment of the gaming system having a game controller 60 comprising a processor 62 arranged to implement a number of modules based on game code 649 stored in a memory 64. Persons skilled in the art will appreciate that the modules are typically implemented using a processor based on code and data stored in memory but that one or more of the modules could alternatively be implemented in some other way, for example by a dedicated circuit.

In the embodiment, the game is feature game that occurs only when a trigger condition (such as a trigger event occurring) is met during a base game. Persons skilled in the art will appreciate that the base game is a part of the game which is carried out each time the player makes a wager, typically irrespective of the wager. In this embodiment, the base game is a spinning reel type game. The spinning reel type game can be line-based or reel-based. The trigger event may be an event occurring during the spinning reel type game (for example, the occurrence of a symbol combination, a specific symbol etc). Persons skilled in the art will appreciate that the game may not be a feature game. Persons skilled in the art will appreciate that base game need not be a spinning reel game but could be a dice game, a card game etc.

The feature game involves a match a prize feature and a spinning wheel feature. The spinning-wheel feature involves a spinning wheel 54B of a player interface 50. The spinning wheel 54B is a spinning wheel type enclosure containing a series of balls. A first award is displayed on each of the balls of the spinning wheel 54B. One of the first awards is a current first award. In this embodiment, each one of the first awards is a multiplier. However, persons skilled in the art will appreciate that one or more of the awards may be different, such as in form of credits. In this embodiment, the first awards are different from one another. However, persons skilled in the art will appreciate one or more of the first awards may be the same as or different to another one or more of the other first awards.

The match a prize feature comprises a plurality of objects for selection by a player. Each one of the objects represents a second award. Examples of awards include monetary prizes, credits etc. The second awards are not revealed to the player prior to selection. The objective of the match a prize feature is to select an object from the plurality of object that matches a designated object (for example, an object representing a second award that matches the second award represented by the designated object). The second award represented by an object is revealed to the player upon selection of the object by the player. Persons skilled in the art will appreciate that the designated object may be an object previously selected by the player from the plurality of objects.

The modules implemented by the processor 62 include a current first award controller 626, a display controller 625 and a selection receiver 623. The current first award controller 626 comprises a current first award modifier 636. The processor 62 also implements an award condition determiner 628 and a prize awarder 629.

The current first award controller 626 is arranged to control the spinning wheel 54B to display a sequence of first awards including the current first award. The current first award controller 626 does this by controlling the spinning wheel 54B to spin. The current first award controller 626 does this when the player initiates a new game using a game play mechanism 56 of the player interface 50. When the spinning wheel 54B stops spinning, the sequence of first awards including the current first award are displayed by the balls contained within the spinning wheel 54B. In this embodiment, the current first award is the first award displayed by the ball of the spinning wheel 54B located at designated part of the spinning wheel 54B which in this case is the bottom of the spinning wheel 54B. Persons skilled in the art will appreciate that the game play mechanism 56 can be any suitable user input device. For example, the game play mechanism 56 may be the form of a touchscreen, one or more buttons etc.

The display controller 625 is arranged to control a display 54A of the player interface 50. Persons skilled in the art will appreciate that the display 54A may be any suitable video display such as a LCD display, a CRT display etc. The display controller 625 controls the display 54A to display the plurality of objects representing the second awards. As indicated above, the second awards are not initially revealed to the player. Instead, the display controller 625 controls the display 54A to reveal the second award represented by the object in response to a selection of one of the objects displayed on the display 54A. The objects are displayed on the display 54A in the form of a two-dimensional array. The second awards represented by the objects are determined based on award data 648 stored in the memory 64 and random numbers generated by a Random Number Generator (RNG) 621. Persons skilled in the art will appreciate that the random numbers may be pseudo random numbers. It is envisaged that, in an alternative embodiment, the display controller 625 may be additionally configured to conceal a second award revealed to the player upon a determination by the award condition determiner 628 that an award condition is not met. In such an embodiment, the display controller 625 may conceal the revealed second award before or after the selection receiver 623 receives a further selection.

The selection receiver 623 is arranged to receive a selection with respect to the plurality of second awards. The selection receiver 623 receives the selection upon the player selecting one of the objects displayed on the display 54A using the game play mechanism 56. As indicated above, upon a selection of an object, the display controller 54A controls the display 54A to display the second award corresponding to the selected object. In this embodiment, the selection receiver 623 is arranged to receive a selection until the award condition determiner 628 makes a determination that an award condition is met. However, it is envisaged that, in an alternative embodiment, the selection receiver 623 may be configured to receive more than one selection until the award condition determiner 628 makes a determination that an award condition is met.

The award condition determiner 628 is arranged to determine whether or not an award condition is met when the player selects one of the objects displayed on the display 54A. The determination is made based on award condition data 643 stored in the memory 64. In this embodiment, the award condition is that the second award represented by the object selected by the player matches the second award represented by a designated object. However, it is envisaged that the award condition may be different. For example, the award condition may be that the second award represented by the selected object corresponds to a second award that is associated with the second award represented by the designated object. In this embodiment, the designated object is a previous object selected by the player. However, it is envisaged that the designated object may be a predetermined object in an alternative embodiment. Also, in this embodiment, the award condition determiner 628 is configured to make a determination of whether or not an award condition is met whenever the selection receiver 623 receives a selection. However, it is envisaged that the award condition determiner 628 may be alternatively configured to make a determination of whether or not the award condition is met only after the selection receiver 623 receives a predetermined number of selections. It is envisaged that the award condition may be different in such an alternative embodiment. For example, in such an embodiment, the award condition determiner 628 may be configured to determine that an award condition is met when the selections involve matching objects.

The current first award controller 626 also comprises a current first award modifier 636. The current first award modifier 636 is arranged to modify the display of the sequence of first awards by nudging or rotating the spinning wheel 54B. This advances the balls contained within the spinning wheel 54B by one position. The current first award modifier 636 nudges the spinning wheel whenever the selection receiver 623 receives a selection. Thus, the balls of the spinning wheel 54B are advanced by one position whenever the selection receiver 623 receives a selection. Whenever the balls of the spinning wheel 54B are advanced by one position, the ball displaying the current first award (that is, the ball at the bottom of the spinning wheel) is changed from one of the series of balls to a subsequent one of the series balls. Thus, the current first award is changed whenever the current first award modifier 636 nudges the spinning wheel 54B The prize awarder 629 is arranged to make the current first award (that is, the first award displayed by the ball at the bottom of the spinning wheel 54B) upon a determination by the awarder determiner 628 that the award condition is met. The prize awarder 629 makes the current first award by applying the multiplier corresponding to the current first award to the matching second award represented by the object selected by the player.

Figure 7:
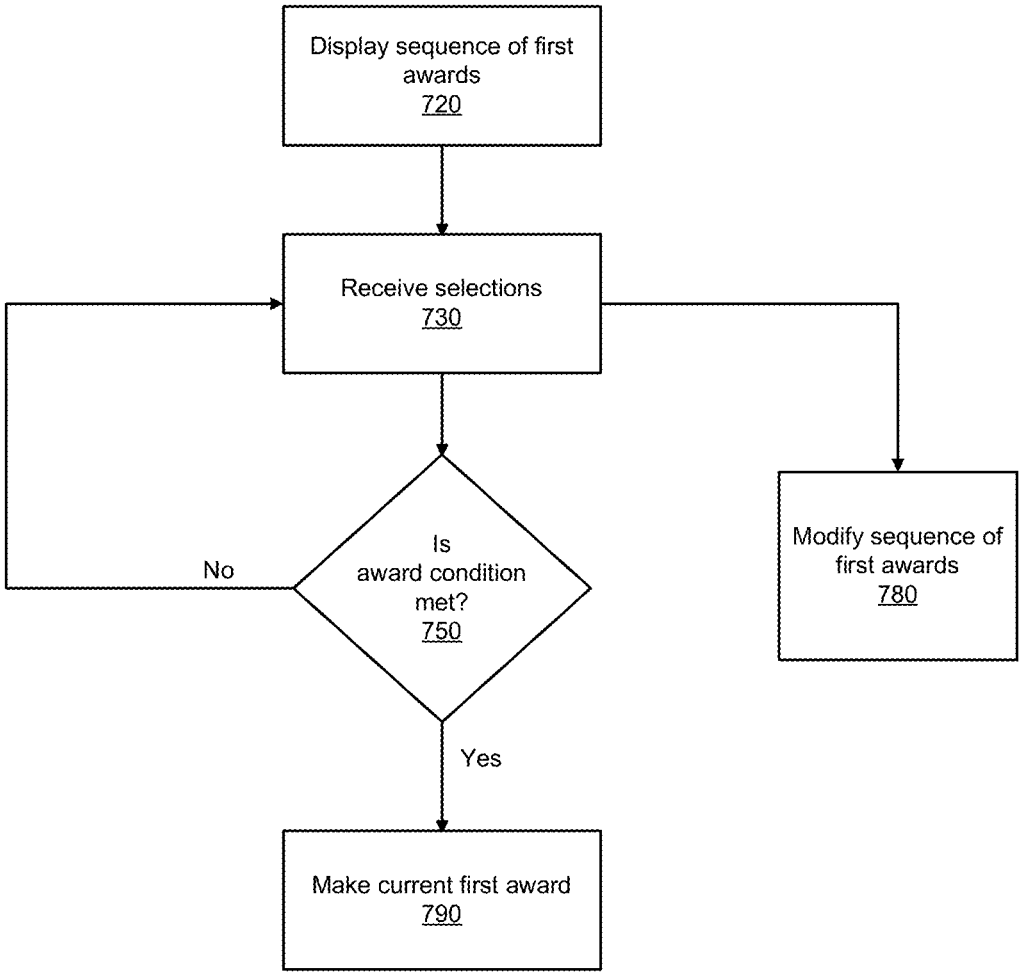
FIG. 7 is a flow chart of an embodiment.

FIG. 7 is a flowchart illustrating an embodiment of the method of gaming. At step 720, a sequence of first awards are displayed on the spinning wheel 54B to the player after the first award controller 626 controls the spinning wheel 54B comprising the series of balls displaying the first awards to spin in response to the initiation of a new feature game triggered after a trigger condition is met with respect to the base game. As indicated above, each one of the first awards is a multiplier. After the sequence of first awards are displayed (that is, after the spinning wheel 54B stopped spinning), the display controller 625 controls the display 54A to display a plurality of objects representing respective second awards on the display 54A based on the award data 648 stored in the memory 64.

At step 730, the selection receiver 623 receives a selection of one of the objects displayed on the display 54A from the game play mechanism 56 of the player interface 50. Upon receipt of the selection, the display controller 625 controls the display 54A to reveal the second award corresponding to the selected object. At step 780, the current first award modifier 636 of the current first award controller 626 controls the spinning wheel 54B to nudge the series of balls in response to the selection receiver 623 receiving the selection of one of the objects. As indicated above, this advances the series of balls by one position.

At step 750, the award condition determiner 628 determines whether or not the award condition is met based on the award condition data 643 stored in the memory 64. As indicated above, the award condition determiner 628 determines that the award condition is met if the second award corresponding to the selected object matches a designated object which in this case is a previously selected object. As this is a new game and the selection receiver 623 has received only one selection, there is no previously selected object. Thus, the award condition determiner 628 determines that the selected object does not match a designated object and that the award condition is not met.

At step 730, the selection receiver 623 receives another selection. Upon receipt of this further selection, the current first award modifier 636 modifies the sequence of first award by nudging the spinning wheel 54B again. This time, the award condition determiner 628 determines that the second award corresponding to the new selection matches the second award corresponding to the previously selected object and that the award condition is met. At step 790, upon the award condition determiner 628 determining that the award condition is met, the prize awarder 629 makes the current first award by applying the multiplier corresponding to the current first award to the selected matching second award.

Further aspects of the method will be apparent from the above description of the system. It will be appreciated that at least part of the method will be implemented digitally by a processor. Persons skilled in the art will also appreciate that the method could be embodied in program code. The program code could be supplied in a number of ways, for example on a tangible computer readable storage medium, such as a disc or a memory (for example, that could replace part of memory 103) or as a data signal (for example, by transmitting it from a server). Persons skilled in the art will appreciate that program code provides a series of instructions executable by the processor.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

EXAMPLE

Figure 8A:
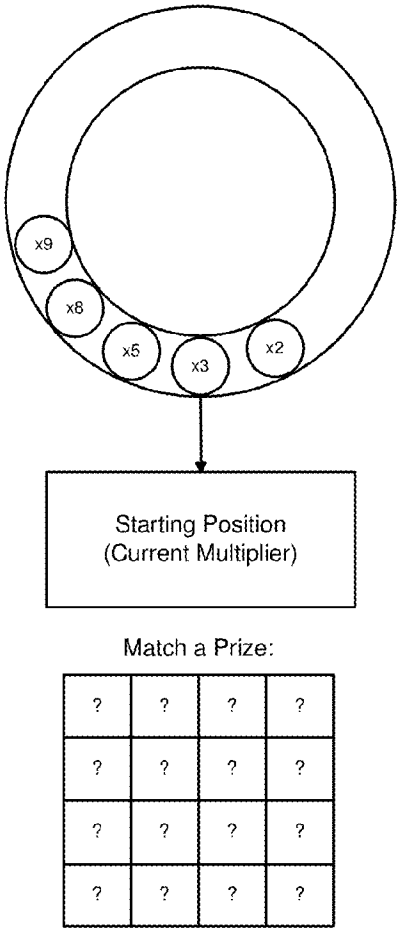
FIGS. 8A, 8B and 8C are diagrammatic representations of an example of a game.
Figure 8B:
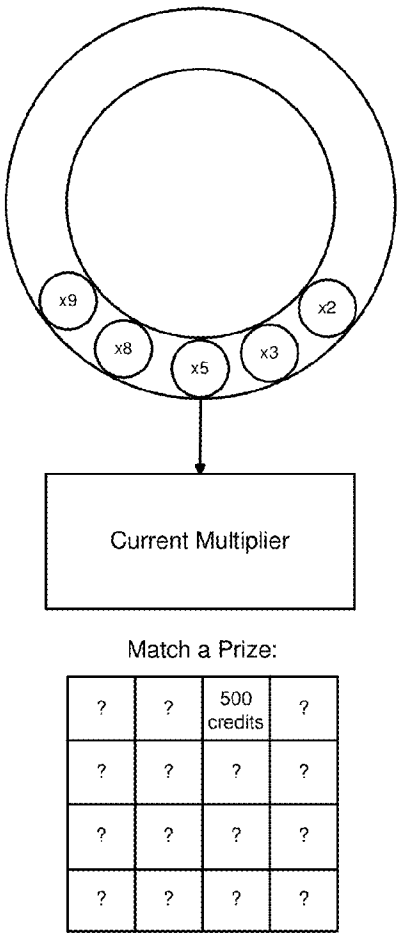
Figure 8C:
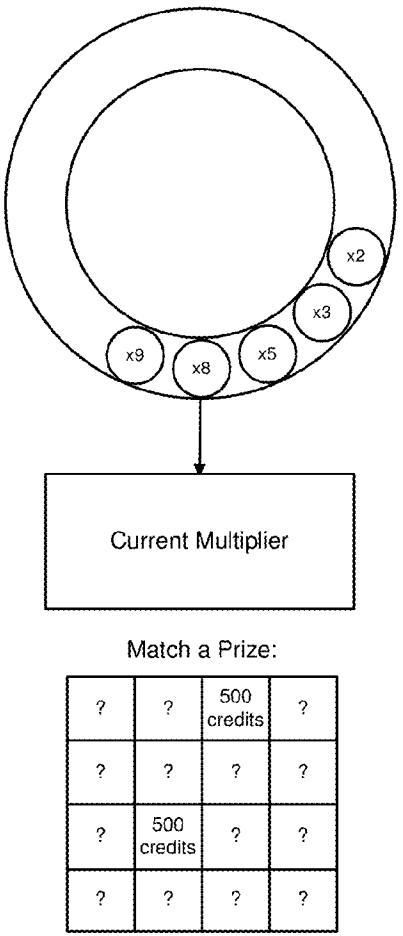

FIGS. 8A to 8C illustrate an example of the game implemented by the gaming system. As indicated above, the game is a feature game that is triggered when a trigger condition is met in a base game. When the feature game is triggered, the current first award controller 626 controls the spinning wheel 54B of the player interface 50 to spin in response to the player initiating the game. The game is initiated by the player using the game play mechanism 56 of the player interface 50.

FIG. 8A illustrates the balls of the spinning wheel 54B after the spinning wheel 54B stopped spinning. As illustrated, the balls display respective first awards in the form of multipliers: "x2", "x3", "x5", "x8" and "x9". Also, the figure illustrates that the current first award (referred to as the current multiplier) is the first award at the bottom of the spinning wheel 54B. As illustrated, the current first award in FIG. 8A is the multiplier "x3".

In addition to the first award controller 626 controlling the spinning wheel 54B to spin, the display controller 625 controls the display 54A of the player interface 50 to display a plurality of objects on the display 54A based on the award data 648 of the memory 64 upon the player initiating the game. FIG. 8A illustrates the plurality of objects displayed on the display 54A. As indicated above, the objects correspond to respective second awards which are not revealed to the player until the player makes a selection. In the figure, the second awards are concealed by "?".

Upon receipt by the selection receiver 623 of a first selection of one of the plurality of objects displayed on the display 54A, the display controller 625 controls the display 54A to reveal the second award corresponding to the selected object on the display 54A to the player. Also, the current first award modifier 636 modifies the sequence of first awards by nudging the spinning wheel 54B by one position. FIG. 8B illustrates the second award revealed to the player: "500 credits". In addition, the figure illustrates the spinning wheel 54B after the current first award modifier 636 modifies the sequence of first awards to change the current first award from the multiplier "x3" to the multiplier "x5".

In response to the selection receiver 623 receiving the selection, the award condition determiner 628 makes a determination of whether or not the award condition is met based on the award condition data 643 of the memory 64. As indicated above, the award condition is that the second award corresponding to the selected object matches the second award corresponding to a designated object (which in this case can be any previously selected object). Upon receipt of the first selection, the award condition determiner 628 determines that the award condition is not met.

Then, the selection receiver 623 receives a second selection from the remaining objects displayed on the display 54A. Upon receipt of the second selection, the current first award controller 625 controls the spinning wheel 54B to nudge the spinning wheel 54B again. This changes the current first award to another one of the first awards displayed by the balls of the spinning wheel 54B. Also, the display controller 625 controls the display 54A to reveal the second award corresponding to the selected object of the second selection. FIG. 8C illustrates that the new current first award is the multiplier "x8" and the object selected by the second selection is "500 credits".

In response to the selection receiver 623 receiving the second selection, the award condition determiner 628 makes another determination of whether or not the award condition is met. Upon receipt of the second selection, the award condition determiner 628 determines that the award condition is met. In response to the determination by the award condition determiner 628 that the award condition is met, the prize awarder 629 makes the current first award by applying the multiplier corresponding to the current first award (that is, the multiplier "x8") to the second award corresponding to the matching object of the second selection (that is, "500 credits").

It will be understood to persons skilled in the art of the invention that many modifications may be made without departing from the spirit and scope of the invention, in particular it will be apparent that certain features of embodiments of the invention can be employed to form further embodiments.

It is to be understood that any reference to prior art made herein does not constitute an admission that the prior art formed or forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of playing a game on a gaming machine having a credit input mechanism configured to receive a physical item associated with a monetary value for establishing a credit balance, the credit balance being increasable and decreasable based at least on wagering activity, a display having a plurality of display positions, an input for receiving player selections, a memory storing data indicative of a sequence of a plurality of first awards including a current first award, a plurality of second awards displayable as a plurality of objects, and an award condition, and a game controller, the electronic method comprising:

establishing a credit balance via said credit input mechanism by receiving the physical item;

in accord with having established the credit balance via the credit input mechanism, displaying on the display via said game controller (1) the sequence of the plurality of first awards including the current first award (2) the plurality of second awards displayable as a plurality of objects and (3) a designated object;

receiving via said player input one or more selections of the plurality of objects displayed on the display until the award condition is met;

modifying via the game controller the display of the sequence of the plurality of first awards to sequentially advance the sequence by at least one position on the display to thereby change the current first award when the one or more selections are received; and awarding the current first award when one of the objects selected matches the designated object to meet the award condition.

2. An electronic method as claimed in claim 1, and wherein each of the one or more selections comprises two of the objects, and wherein the award condition further includes one of the objects selected matching another one of the objects selected.

3. An electronic method as claimed in claim 1, and further comprising displaying a plurality of previously selected objects on the display, and wherein the award condition further includes one of the objects selected matches one of the plurality of previously selected objects.

4. An electronic method as claimed in claim 1, and further comprising concealing the second awards on the display prior to selecting one or more of the objects.

5. An electronic method as claimed in claim 1, and further comprising revealing the second awards corresponding to the objects selected on the display upon selecting one or more of the objects.

6. An electronic method as claimed in claim 5, and further comprising concealing the second awards corresponding to the objects selected on the display when the award condition is not met.

7. An electronic method as claimed in claim 6, and further comprising concealing the second awards corresponding to the objects selected prior to selecting another one or more of the objects on the display.

8. An electronic method as claimed in claim 1, and further comprising displaying on the display the first awards as a plurality of balls enclosed in a spinning wheel.

9. An electronic method as claimed in claim 8, wherein modifying via the game controller the display of the sequence of the plurality of first awards includes rotating the spinning wheel.

10. An electronic method as claimed in claim 8, and further comprising displaying on the display a spinning of the spinning wheel prior to receiving any of said one or more selections.

11. An electronic method as claimed in claim 10, and further comprising displaying on the display a re-spinning of the spinning wheel when the outcome award is awarded.

12. An electronic method as claimed in claim 1, wherein at least one of the first awards is a multiplier.

13. An electronic method as claimed in claim 12, wherein the current first award includes a multiplier, and wherein awarding the current first award comprises applying the multiplier corresponding to the current first award to the second award corresponding to the object matching the designated object.

14. An electronic method as claimed in claim 12, and further comprising displaying the second awards as a plurality of objects, and wherein the current first award includes a multiplier, and wherein said awarding the outcome award comprises applying the multiplier to a second award.

15. An electronic method as claimed in claim 1, and further comprising displaying the designated object together with the plurality of objects on the display in the form of an array.

16. A game controller for playing a game on a gaming system having a credit input mechanism configured to receive a physical item associated with a monetary value for establishing a credit balance, the credit balance being increasable and decreasable based at least on wagering activity, a display having a plurality of display positions, an input configured to receive player selections, and a memory storing data indicative of a sequence of a plurality of first awards including a current first award, a plurality of second awards displayable as a plurality of objects, and an award condition, the game controller comprising:

a display controller configured to display in accord with having established the credit balance via the credit input mechanism, (1) the sequence of the plurality of first awards including the current first award, (2) the plurality of second awards displayed as a plurality of objects and (3) a designated object;

a selection receiver configured to receive via the input one or more selections of the plurality of objects displayed on the display until the award condition is met;

a current first award modifier configured to modify the display of the sequence of the plurality of first awards to sequentially advance the sequence by at least one position on the display to thereby change the current first award when the one or more selections are received; and a prize awarder configured to award the current first award when one of the objects selected matches the designated object to meet the award condition.

17. A game controller as claimed in claim 16, and further comprising an award condition determiner configured to determine whether or not one of the objects selected matches the designated object.

18. A gaming system for playing a game, the gaming system comprising:

a credit input mechanism configured to receive a physical item associated with a monetary value for establishing a credit balance, the credit balance being increasable and decreasable based at least on wagering activity;

a display having a plurality of display positions;

a memory configured to store data indicative of a sequence of a plurality of first awards including a current first award, a plurality of second awards displayable as a plurality of objects, and an award condition;

an input configured to receive player selections; and a game controller configured to:

cause on the display a display in accord with having established the credit balance via the credit input mechanism (1) the sequence of the plurality of first awards including the current first award, (2) the plurality of second awards displayed as a plurality of objects and (3) a designated object;

receive via the input one or more selections of the plurality of objects displayed on the display until the award condition is met;

modify the display of the sequence of the plurality of first awards to sequentially advance the sequence by a position on the display to thereby change the current first award when the one or more selections are received; and award the current first award when one of the objects selected matches the designated object to meet the award condition.

19. A gaming system as claimed in claim 18, wherein the display is further configured to display the game as a spinning wheel game, and wherein the display is further configured to display the first awards as a plurality of balls enclosed in the spinning wheel.

20. A game system as claimed in claim 18, wherein the game controller is further configured to determine whether or not the award condition is met.

21. A gaming machine for playing a game, the gaming machine comprising:

a credit input mechanism configured to receive a physical item associated with a monetary value for establishing a credit balance, the credit balance being increasable and decreasable based at least on wagering activity;

a display having a plurality of display positions;

a memory configured to store data indicative of a sequence of a plurality of first awards including a current first award, a plurality of second awards displayable as a plurality of objects, and an award condition;

a first award controller configured to cause on the display a display in accord with having established the credit balance via the credit input mechanism, (1) the sequence of the plurality of first awards including the current first award, (2) the plurality of second awards displayed as a plurality of objects and (3) a designated object;

an award condition determiner configured to determine if the award condition is met;

a selection receiver configured to receive one or more selections of the plurality of objects displayed on the display until the award condition determiner determines that the award condition is met;

a first award modifier configured to modify the display of the sequence of the plurality of first awards to sequentially advance the sequence by at least one position on the display to thereby change the current first award when the selection receiver receives the one or more selections; and a prize awarder configured to award the current first award when the award condition determiner determines that the award condition is met; and wherein the award condition determiner is configured to determine that the award condition is met when one of the objects selected matches the designated object.

* * * * *